US008689367B2

(12) United States Patent
Nguyen

(10) Patent No.: US 8,689,367 B2
(45) Date of Patent: Apr. 8, 2014

(54) ADJUSTABLE TOILET SEAT HANDLE

(76) Inventor: Thai Quoc Nguyen, San Jose, CA (US)

( * ) Notice: Subject to any disclaimer, the term of this patent is extended or adjusted under 35 U.S.C. 154(b) by 56 days.

(21) Appl. No.: 13/439,120

(22) Filed: Apr. 4, 2012

(65) Prior Publication Data

US 2013/0263368 A1 Oct. 10, 2013

Related U.S. Application Data

(63) Continuation-in-part of application No. 29/415,734, filed on Mar. 14, 2012, now abandoned.

(51) Int. Cl.
*A47K 13/10* (2006.01)

(52) U.S. Cl.
USPC ..... 4/246.1

(58) Field of Classification Search
USPC ..... 4/246.1, 661; 16/422, 426, 417, 441, 16/DIG. 24, DIG. 25
See application file for complete search history.

(56) References Cited

U.S. PATENT DOCUMENTS

| | | | | |
|---|---|---|---|---|
| 2,318,518 | A * | 5/1943 | Opperer | 4/246.1 |
| 2,792,932 | A * | 5/1957 | Freistat | 24/523 |
| 3,431,004 | A * | 3/1969 | Schell | 4/253 |
| 4,536,926 | A * | 8/1985 | Pantaleo | 24/523 |
| 5,027,472 | A | 7/1991 | Goodman | |
| D325,510 | S | 4/1992 | Slye | |
| 5,450,659 | A * | 9/1995 | Bertram | 24/523 |
| 5,511,252 | A | 4/1996 | Kreemer | |
| D371,434 | S | 7/1996 | Ouzounian | |
| D398,041 | S | 9/1998 | Kitt | |
| 5,963,992 | A | 10/1999 | Bonner | |
| 7,676,857 | B1 * | 3/2010 | Zuidema | 4/246.1 |
| 2004/0107486 | A1 | 6/2004 | Yoo | |

FOREIGN PATENT DOCUMENTS

US WO03063671 A1 8/2003

* cited by examiner

*Primary Examiner* — Huyen Le
*Assistant Examiner* — Erin Deery
(74) *Attorney, Agent, or Firm* — Ash Tankha; Lipton, Weinberger & Husick

(57) ABSTRACT

An adjustable toilet seat handle including a clamping assembly, a spring member, and a knob is provided. The clamping assembly having a first clamp and a second clamp is removably connected to an undersurface of a toilet seat. A spring member connects the first clamp to the second clamp for defining a receptacle that compression fits the undersurface of the toilet seat. The spring member is operably connected to a lower surface of the clamping assembly and extends a distance between the first clamp and the second clamp to allow the undersurface of the toilet seat to be compression fitted in the receptacle. The knob is rigidly attached to and extends outwardly from the first clamp and can be gripped by a user to allow the user to raise or lower the toilet seat without direct contact with the toilet seat.

12 Claims, 10 Drawing Sheets

ADJUSTABLE TOILET SEAT HANDLE

CROSS-REFERENCE TO RELATED APPLICATIONS

This application is a continuation-in-part of U.S. Design application Ser. No. 29/415,734, titled "Adjustable Toilet Seat Handle", filed Mar. 14, 2012, in the United States Patent and Trademark Office, and is hereby incorporated by reference in its entirety.

BACKGROUND

Due to its proximity to a toilet bowl, a toilet seat is likely to get contaminated by germs from the toilet bowl. Since a toilet is generally not sanitized following each use, germs residing on the toilet seat may be transferred to users who raise or lower the toilet seat before or after use. A user of the toilet typically uses his/her hand to raise or lower the toilet seat by manually grasping an edge or an undersurface of the toilet seat, which may transfer germs to the user's hand and may cause the user to contract infections. Conventional toilet seat handles used to avoid direct hand contact with the toilet seat typically do not fit a toilet seat of different sizes and cannot be adjusted to compression fit on a toilet seat of different sizes.

Hence, there is a long felt but unresolved need for an adjustable toilet seat handle that is configurable to compression fit on a toilet seat of any size for allowing a user to raise or lower the toilet seat without direct hand contact with the toilet seat.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The apparatus disclosed herein addresses the above mentioned need for an adjustable toilet seat handle that is configurable to compression fit on a toilet seat of any size for allowing a user to raise or lower the toilet seat without direct hand contact with the toilet seat. The adjustable toilet seat handle disclosed herein comprises a clamping assembly, a spring member, and a knob. The clamping assembly is configured to removably connect to an undersurface of a toilet seat. The clamping assembly comprises a first clamp and a second clamp. The first clamp is connected to the second clamp by a spring member for defining a receptacle that compression fits the undersurface of the toilet seat. The first clamp is, for example, an L-shaped clamp. The second clamp comprises an angularly bent end configured for gripping an inner side surface of the toilet seat.

In an embodiment, a slot is positioned at a predetermined location, for example, at a mid-section on each of the first clamp and the second clamp of the clamping assembly for adjustably positioning each of the first clamp and the second clamp on the undersurface of the toilet seat. The predetermined location of the slot is determined, for example, based on a length of the spring member. In an embodiment, a hook member extends downwardly from the slot of each of the first clamp and the second clamp of the clamping assembly, below the lower surface of the clamping assembly for supporting the spring member. In an embodiment, the slot is adjustably constructed to enable configuration of the hook member extending downwardly from the slot of each of the first clamp and the second clamp of the clamping assembly.

The spring member of the adjustable toilet seat handle is operably connected to a lower surface of the clamping assembly. The spring member is, for example, a tension spring made of stainless steel. The spring member is configured to extend a distance between the first clamp and the second clamp of the clamping assembly to allow the undersurface of the toilet seat to be compression fitted in the receptacle. The upper surface of the clamping assembly is configured to grippingly contact the undersurface of the toilet seat. The spring member comprises a loop opening at each opposing end of the spring member for connecting each opposing end of the spring member onto the hook member that extends downwardly from the slot of each of the first clamp and the second clamp of the clamping assembly.

The knob is rigidly attached to and extends outwardly from the first clamp of the clamping assembly. The knob is configured to be gripped by a user to allow the user to raise the toilet seat in an upward direction or lower the toilet seat in a downward direction without direct contact with the toilet seat. The shape of the knob is, for example, a spherical shape, a cylindrical shape, a cubical shape, a square shape, a rectangular shape, or any other shape suitable for gripping by a user.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and components disclosed herein.

DETAILED DESCRIPTION OF THE INVENTION

Figure 1A:
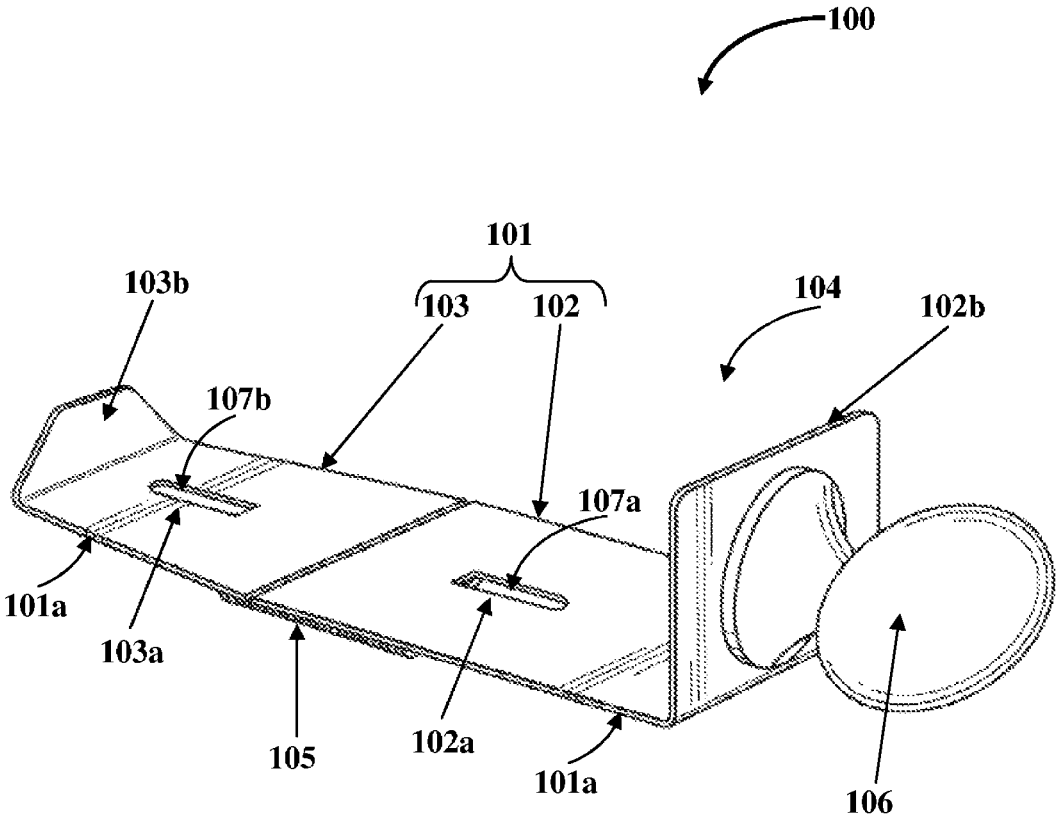
FIG. 1A exemplarily illustrates a front isometric view of an adjustable toilet seat handle.

FIG. 1A exemplarily illustrates a front isometric view of an adjustable toilet seat handle 100. The adjustable toilet seat handle 100 comprises a clamping assembly 101, a spring member 105, and a knob 106. The clamping assembly 101 is configured to removably connect to an undersurface 801*b* of a toilet seat 801 as exemplarily illustrated in FIGS. 8-9. The clamping assembly 101 comprises a first clamp 102 and a second clamp 103. The first clamp 102 is connected to the second clamp 103 by the spring member 105 for defining a receptacle 104 that compression fits the undersurface 801*b* of the toilet seat 801. In an embodiment, the first clamp 102 is an L-shaped clamp as exemplarily illustrated in FIGS. 2-3 and FIG. 8. The second clamp 103 comprises an angularly bent end 103*b* configured for gripping an inner side surface 801*a* of the toilet seat 801 as exemplarily illustrated in FIGS. 8-9.

Figure 1B:
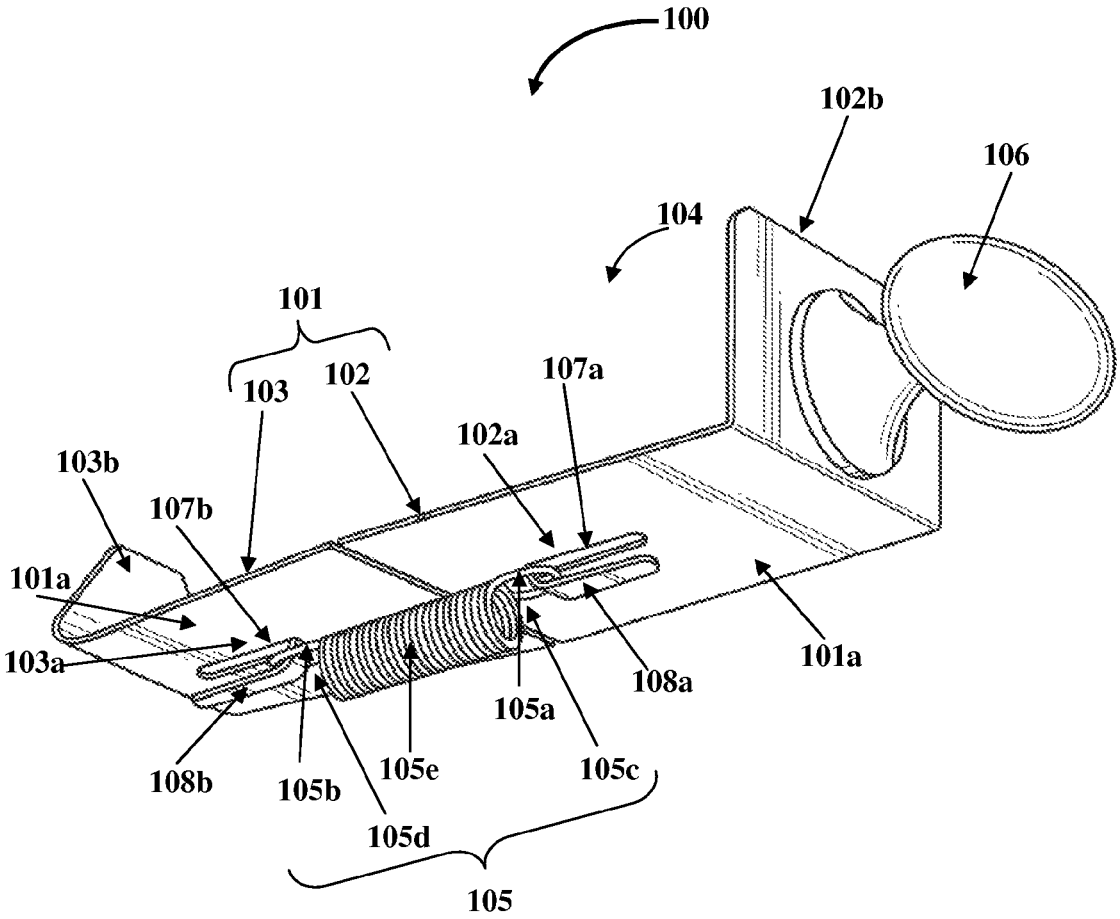
FIG. 1B exemplarily illustrates a bottom isometric view of the adjustable toilet seat handle.

The spring member 105 of the adjustable toilet seat handle 100 is operably connected to a lower surface 101*a* of the clamping assembly 101 as disclosed in the detailed description of FIG. 1B. The knob 106 is rigidly attached to and extends outwardly from the first clamp 102 of the clamping assembly 101. The knob 106 is rigidly attached proximal to the upper end 102*b* of the L-shaped first clamp 102. The knob 106 is configured to be gripped by a user to allow the user to raise the toilet seat 801 in an upward direction or lower the toilet seat 801 in a downward direction without direct contact with the toilet seat 801 as exemplarily illustrated in FIG. 9. In an embodiment, the first clamp 102 and the second clamp 103 comprise slots 107*a* and 107*b* respectively, positioned at predetermined locations, for example, at their mid-sections 102*a* and 103*a* respectively as disclosed in the detailed description of FIG. 4. The slots 107*a* and 107*b* enable a user to adjustably position the first clamp 102 and the second clamp 103 respectively on the undersurface 801*b* of the toilet seat 801. The predetermined location of each of the slots 107*a* and 107*b* is determined, for example, based on a length of the spring member 105.

FIG. 1B exemplarily illustrates a bottom isometric view of the adjustable toilet seat handle 100. The spring member 105 operably connected to the lower surface 101*a* of the clamping assembly 101 of the adjustable toilet seat handle 100 is exemplarily illustrated in FIG. 1B. The spring member 105 is, for example, a tension spring made of stainless steel. The stainless steel tension spring member 105 is moisture resistant and is therefore effective for use in the typically wet environment around a toilet bowl. Due to its corrosive resistant nature, the stainless steel tension spring member 105 can be used in a high moisture environment without corroding. In an embodiment, the adjustable toilet seat handle 100 further comprises hook members 108*a* and 108*b* that extend downwardly from the slots 107*a* and 107*b* of the first clamp 102 and the second clamp 103 respectively, of the clamping assembly 101. The hook members 108*a* and 108*b* extend below the lower surface 101*a* of the clamping assembly 101 for supporting the spring member 105. The spring member 105 has a helically coiled body 105*e* and comprises loop openings 105*a* and 105*b* at the opposing ends 105*c* and 105*d* respectively, of the helically coiled body 105*e* of the spring member 105. The loop openings 105*a* and 105*b* connect the opposing ends 105*c* and 105*d* of the spring member 105 respectively to the hook members 108*a* and 108*b* of the first clamp 102 and the second clamp 103 respectively. The hook members 108*a* and 108*b* of the first clamp 102 and the second clamp 103 respectively allow the spring member 105 to be removed and replaced easily.

The slots 107*a* and 107*b* of the first clamp 102 and the second clamp 103 respectively are adjustably constructed to enable configuration of the hook members 108*a* and 108*b* respectively extending downwardly from the slots 107*a* and 107*b* of the first clamp 102 and the second clamp 103 respectively. The slots 107*a* and 107*b* enable a user to view the spring member 105 from the top of the adjustable toilet seat handle 100 to ensure that the spring member 105 is correctly positioned and attached to the hook members 108*a* and 108*b*, prior to attaching the adjustable toilet seat handle 100 to the undersurface 801*b* of the toilet seat 801 exemplarily illustrated in FIGS. 8-9. The predetermined locations for positioning the slots 107*a* and 107*b* on the first clamp 102 and the second clamp 103 respectively can be varied based on the length of the spring member 105.

Figure 2:
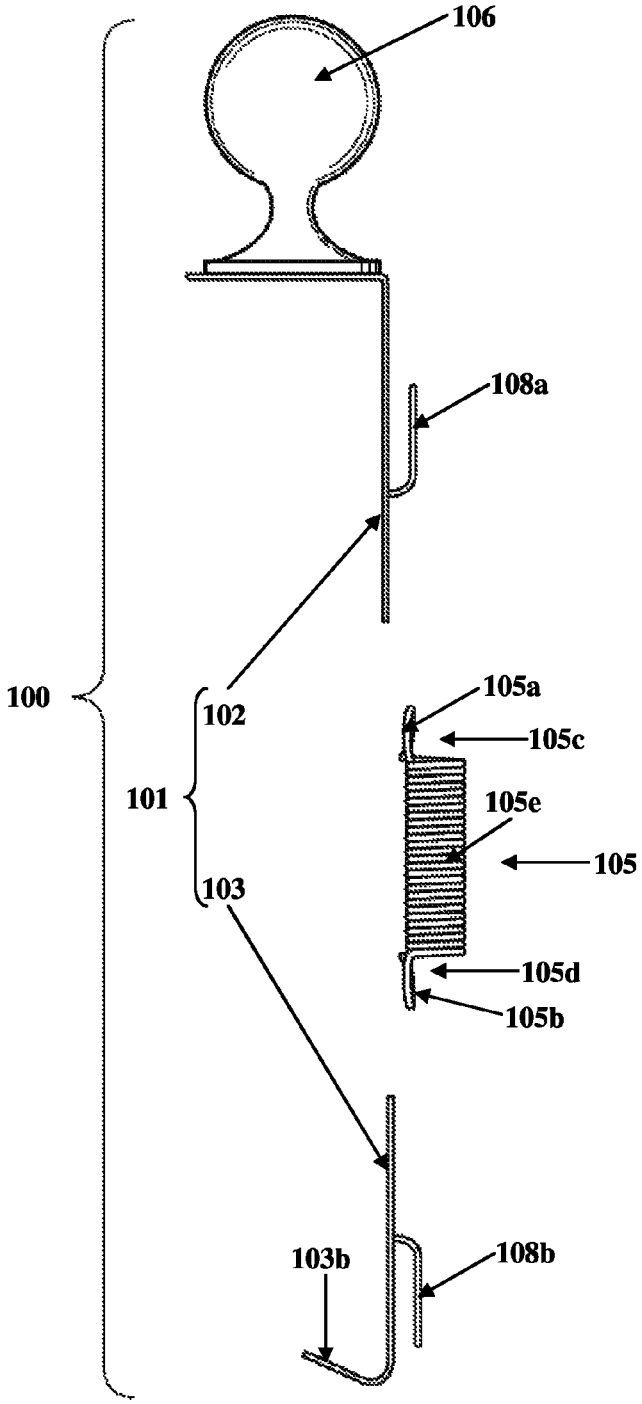
FIG. 2 exemplarily illustrates a disassembled orthographic view of the adjustable toilet seat handle.
Figure 3:
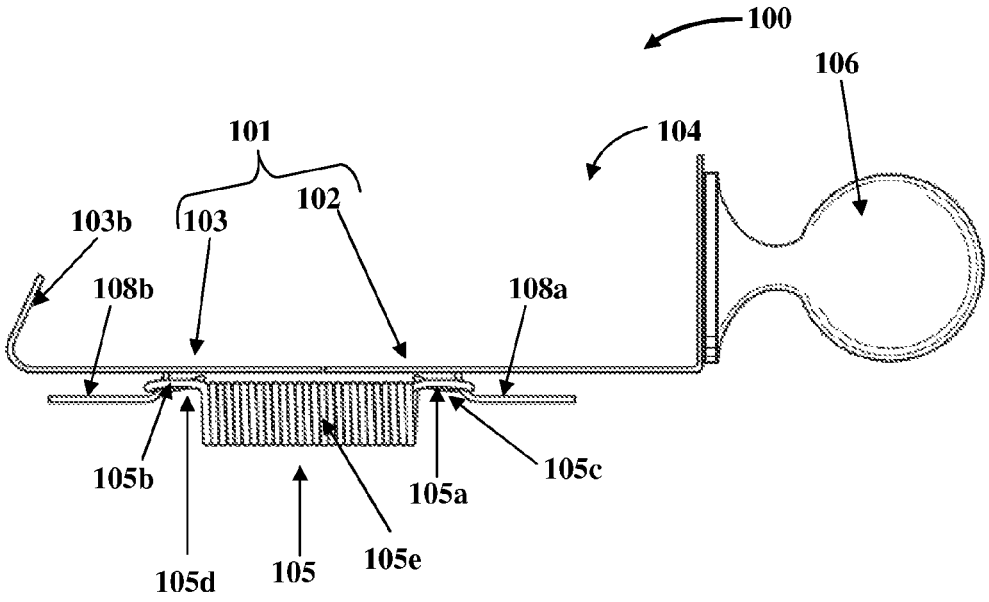
FIG. 3 exemplarily illustrates an assembled orthographic view of the adjustable toilet seat handle.

FIG. 2 and FIG. 3 exemplarily illustrate a disassembled orthographic view and an assembled orthographic view respectively, of the adjustable toilet seat handle 100. FIG. 2 shows the first clamp 102, the spring member 105, and the second clamp 103 of the adjustable toilet seat handle 100 disclosed in the detailed description of FIGS. 1A-1B. The spring member 105 is configured to extend the distance 109 between the first clamp 102 and the second clamp 103 of the clamping assembly 101 to allow the undersurface 801*b* of the toilet seat 801 to be compression fitted in the receptacle 104 as exemplarily illustrated in FIG. 8. The first clamp 102, the spring member 105, and the second clamp 103 of the adjustable toilet seat handle 100 are assembled as exemplarily illustrated in FIG. 3.

Figure 4:
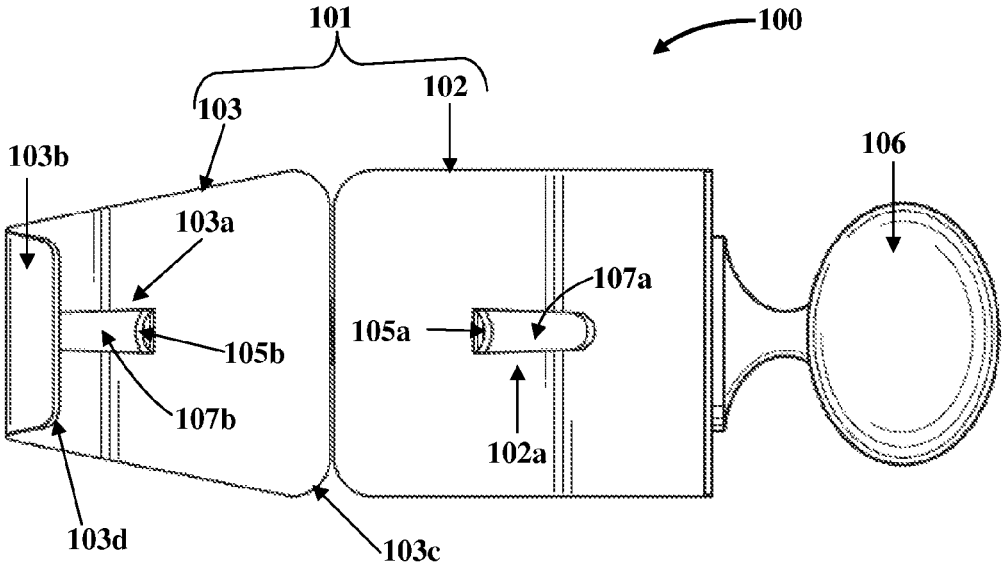
FIG. 4 exemplarily illustrates a top orthographic view of the adjustable toilet seat handle.

FIG. 4 exemplarily illustrates a top orthographic view of the adjustable toilet seat handle 100. FIG. 4 shows the angularly bent end 103*b* of the second clamp 103 used for gripping the inner side surface 801*a* of the toilet seat 801 as exemplarily illustrated in FIGS. 8-9. FIG. 4 also shows the slots 107*a* and 107*b* positioned at predetermined locations, for example, at the mid-sections 102*a* and 103*a* on the first clamp 102 and the second clamp 103 respectively. During assembly and installation of the adjustable toilet seat handle 100 on the toilet seat 801, the user can vary the position of the first clamp 102 and the second clamp 103 on the undersurface 801*b* of the toilet seat 801 using the slots 107*a* and 107*b* of the first clamp 102 and the second clamp 103 respectively. FIG. 4 also shows the lower portion 103*c* and an upper portion 103*d* of the second clamp 103. The lower portion 103*c* of the second clamp 103 tapers in the direction of the upper portion 103*d* having the angularly bent end 103*b* which grips the inner side surface 801*a* of the toilet seat 801.

Figure 5:
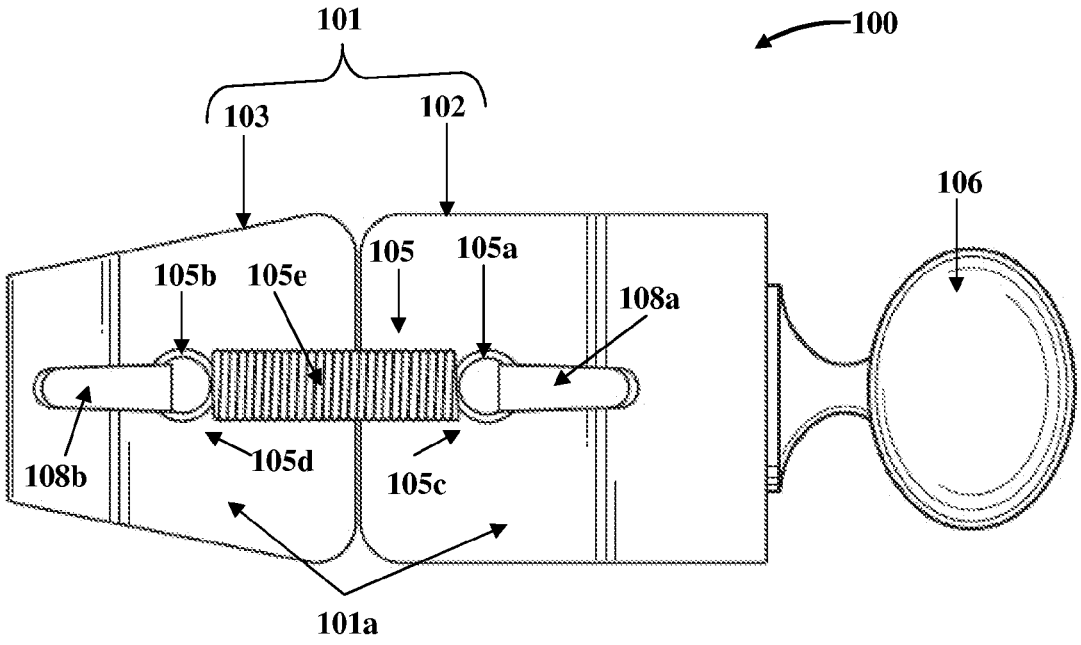
FIG. 5 exemplarily illustrates a bottom orthographic view of the adjustable toilet seat handle.

FIG. 5 exemplarily illustrates a bottom orthographic view of the adjustable toilet seat handle 100. FIG. 5 shows the single loop openings 105*a* and 105*b* of the spring member 105 connected to the hook members 108*a* and 108*b* respectively extending downwardly from the first clamp 102 and the second clamp 103 respectively, below the lower surface 101*a* of the clamping assembly 101.

Figure 6:
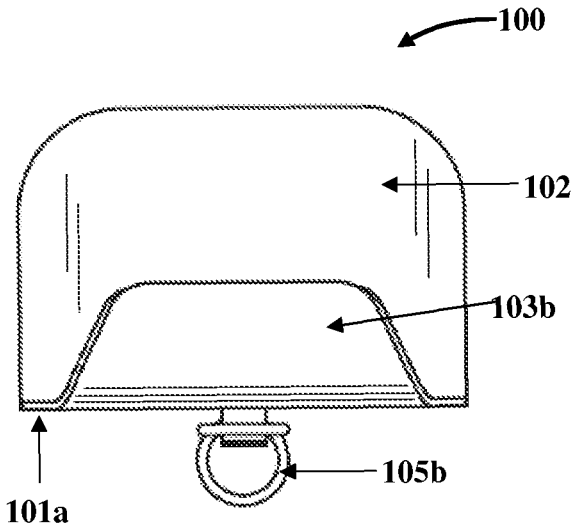
FIG. 6 exemplarily illustrates a left side orthographic view of the adjustable toilet seat handle.
Figure 7:
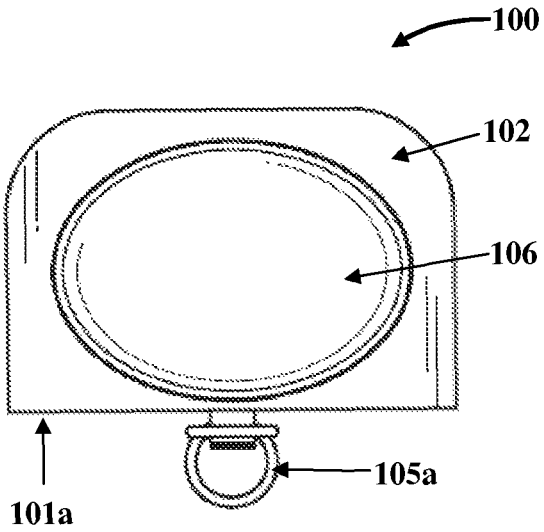
FIG. 7 exemplarily illustrates a right side orthographic view of the adjustable toilet seat handle.

FIG. 6 and FIG. 7 exemplarily illustrate a left side orthographic view and a right side orthographic view respectively, of the adjustable toilet seat handle 100. The left side orthographic view of the adjustable toilet seat handle 100, exemplarily illustrated in FIG. 6, shows the angularly bent end 103*b* of the second clamp 103 used for gripping an inner side surface 801*a* of the toilet seat 801 as exemplarily illustrated in FIGS. 8-9. The right side orthographic view of the adjustable toilet seat handle 100, exemplarily illustrated in FIG. 7, shows the knob 106 rigidly attached to the first clamp 102 for gripping by a user. The shape of the knob 106 is, for example, a generally spherical shape. The knob 106 may also have, for example, a cylindrical shape, a cubical shape, a square shape, a rectangular shape, or any shape suitable for gripping by a user. FIGS. 6-7 also show the loop openings 105*b* and 105*a* of the spring member 105 that extends below the lower surface 101*a* of the clamping assembly 101 exemplarily illustrated in FIG. 1B.

Figure 8:
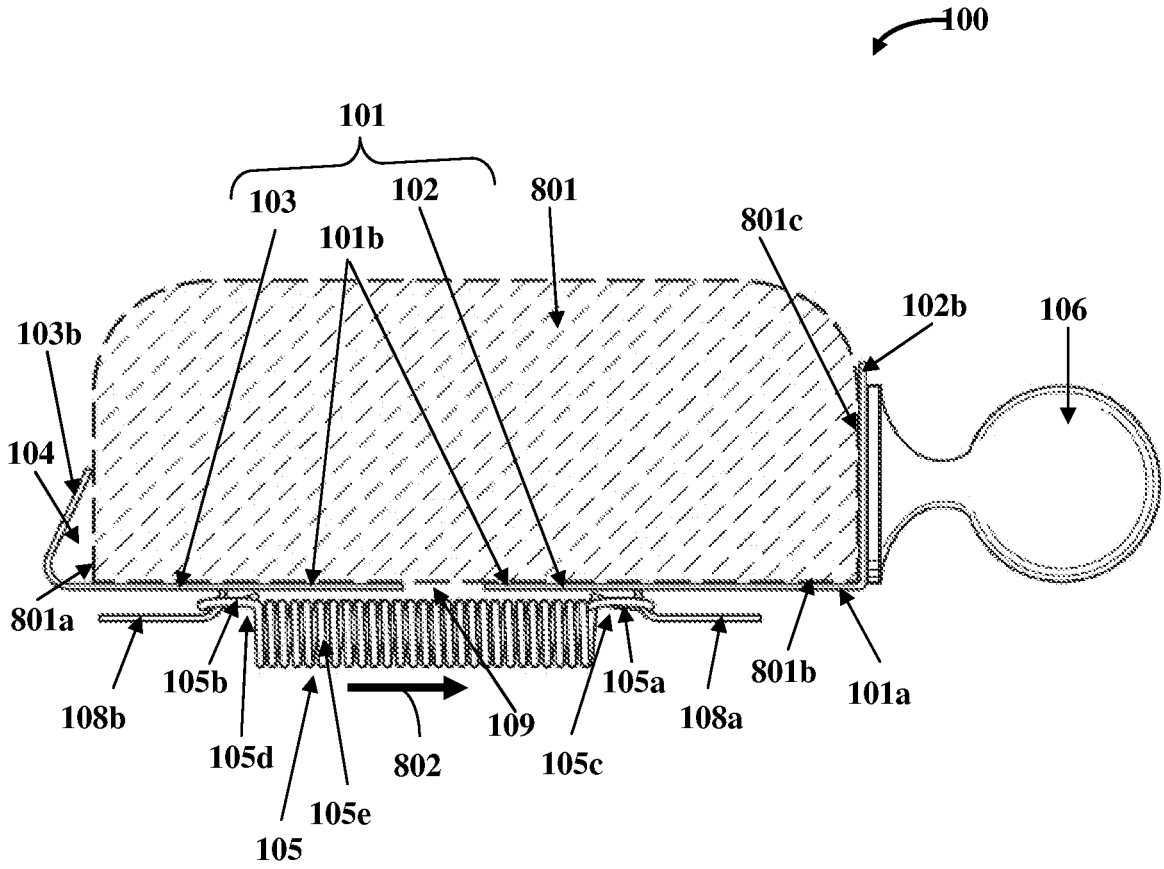
FIG. 8 exemplarily illustrates a front orthographic view of the adjustable toilet seat handle attached to an undersurface of a toilet seat.

FIG. 8 exemplarily illustrates a front orthographic view of the adjustable toilet seat handle 100 attached to an undersurface 801*b* of a toilet seat 801. The adjustable toilet seat handle 100 grips the inner side surface 801*a* of the toilet seat 801 through the angularly bent end 103*b* of the second clamp 103. The spring member 105 is configured to expand to extend the clamping assembly 101 to accommodate the undersurface 801*b* of the toilet seat 801 in the receptacle 104 and to compress for positioning the clamping assembly 101 in a compression fit configuration on the undersurface 801*b* of the toilet seat 801. The spring member 105 is extendable to removably compress fit the first clamp 102 and the second clamp 103 of the clamping assembly 101 on the undersurface 801*b* of the toilet seat 801.

For attaching the adjustable toilet seat handle 100 to the undersurface 801*b* of the toilet seat 801, the angularly bent end 103*b* of the second clamp 103 is positioned on the inner side surface 801*a* of the toilet seat 801 and the spring member 105 is extended by the application of a force along the direction shown by the arrow 802 in FIG. 8, till the end 102*b* of the first clamp 102 reaches the outer side surface 801*c* of the toilet seat 801, thereby accommodating the undersurface 801*b* of the toilet seat 801 in the receptacle 104. The upper surface 101*b* of the clamping assembly 101 is configured to grippingly contact the undersurface 801*b* of the toilet seat 801. The spring member 105 is expanded to extend the distance 109 between the first clamp 102 and the second clamp 103 to allow the angularly bent end 103*b* of the second clamp 103 to grip the adjustable toilet seat handle 100 against the inner side surface 801*a* of the toilet seat 801 and to allow the clamping assembly 101 to grip the undersurface 801*b* of the toilet seat 801 of different widths. When the adjustable toilet seat handle 100 is attached to the undersurface 801*b* of the toilet seat 801, the toilet seat 801 extends beyond the upper end 102*b* of the L-shaped first clamp 102. The adjustable toilet seat handle 100 can be attached to either side of the toilet seat 801 depending on the user's preference.

Figure 9:
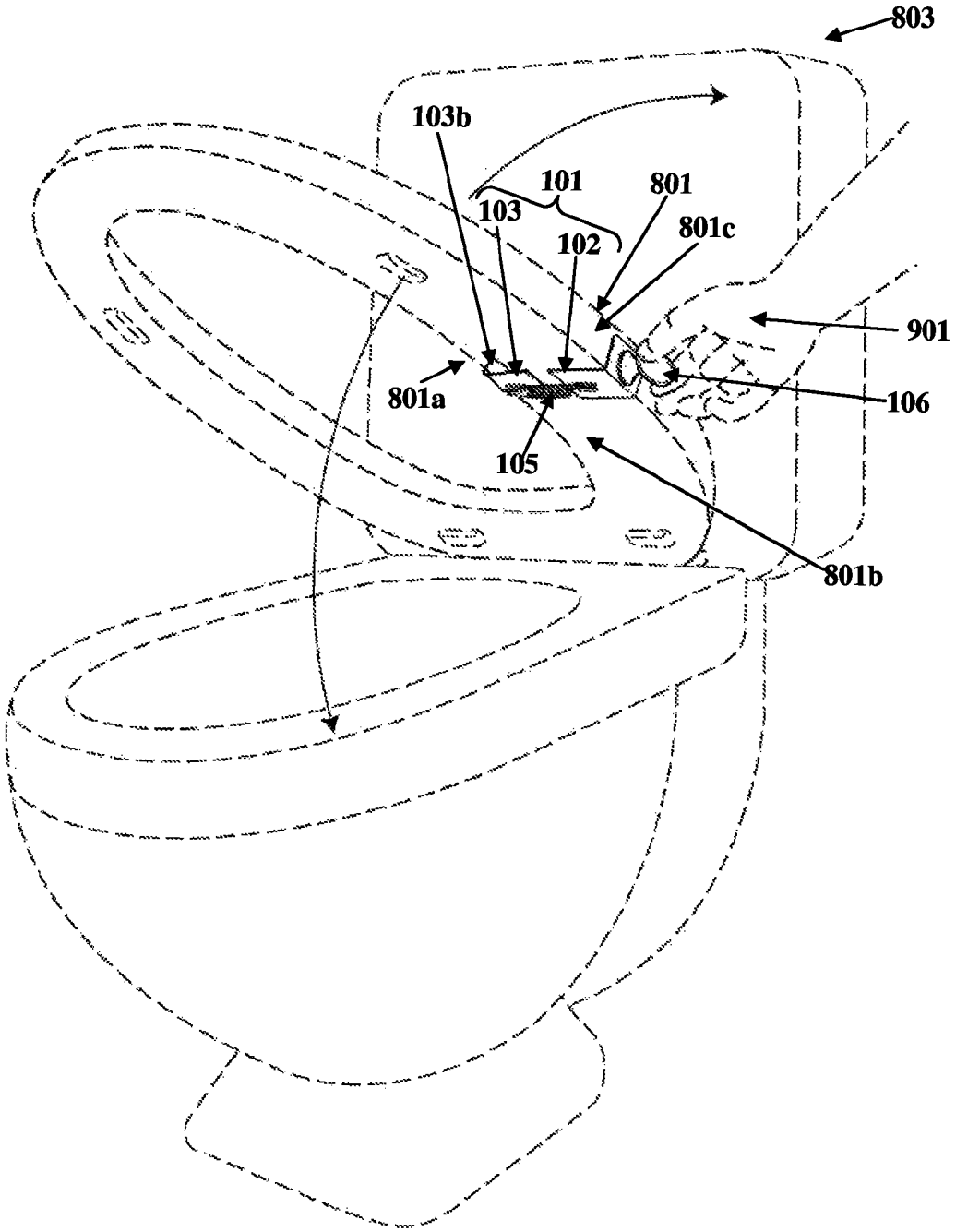
FIG. 9 exemplarily illustrates a front perspective view, showing the adjustable toilet seat handle attached to an undersurface of a toilet seat for allowing a user to raise the toilet seat in an upward direction or lower the toilet seat in a downward direction without direct contact with the toilet seat.

FIG. 9 exemplarily illustrates a front perspective view, showing the adjustable toilet seat handle 100 attached to an undersurface 801*b* of a toilet seat 801 for allowing a user to raise the toilet seat 801 in an upward direction or lower the toilet seat 801 in a downward direction without direct contact with the toilet seat 801. As illustrated in FIG. 9, the spring member 105 of the adjustable toilet seat handle 100 can be expanded and compressed to adjustably attach the adjustable toilet seat handle 100 to the undersurface 801*b* of a toilet seat 801 of varying dimensions. A user can hold the knob 106 of the attached toilet seat handle 100 with his/her hand 901 and then raise or lower the toilet seat 801 as exemplarily illustrated in FIG. 9, during use of the toilet 803, without touching the toilet seat 801.

Figure 10:
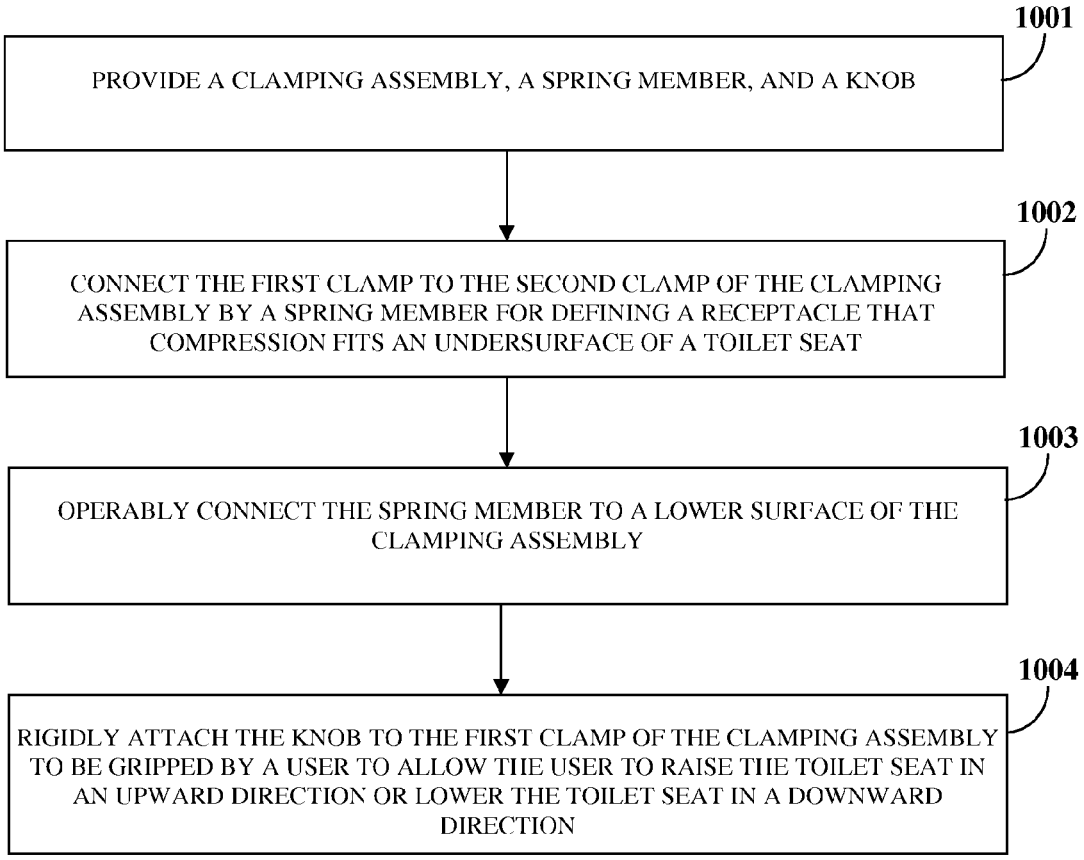
FIG. 10 illustrates a method for assembling an adjustable toilet seat handle.

FIG. 10 illustrates a method for assembling an adjustable toilet seat handle 100. A clamping assembly 101 comprising a first clamp 102 and a second clamp 103, a spring member 105, and a knob 106 as exemplarily illustrated in FIG. 2, is provided 1001. To assemble the adjustable toilet seat handle 100, the first clamp 102 is connected 1002 to the second clamp 103 by the spring member 105 for defining a receptacle 104 that compression fits the undersurface 801*b* of the toilet seat 801 as exemplarily illustrated in FIG. 8. The spring member 105 is operably connected 1003 to a lower surface 101*a* of the clamping assembly 101. For example, the loop openings 105*a* and 105*b* at the opposing ends 105*c* and 105*d* of the spring member 105 respectively are inserted onto the hook members 108*a* and 108*b* that extend downwardly from the slots 107*a* and 107*b* respectively positioned at predetermined locations, for example, at the mid-sections 102*a* and 103*a* on the first clamp 102 and the second clamp 103 of the clamping assembly 101 as exemplarily illustrated in FIG. 1B, FIG. 3, FIG. 5, and FIG. 8. The spring member 105 is configured to extend the distance 109 between the first clamp 102 and the second clamp 103 of the clamping assembly 101 to accommodate the undersurface 801*b* of the toilet seat 801 in the receptacle 104 and to allow the first clamp 102 and the second clamp 103 to compression fit the undersurface 801*b* of the toilet seat 801. The knob 106 is rigidly attached 1004 to the first clamp 102 of the clamping assembly 101 to be gripped by a user to allow the user to raise the toilet seat 801 in an upward direction or lower the toilet seat 801 in a downward direction without direct contact with the toilet seat 801 as exemplarily illustrated in FIG. 9.

Figure 11:
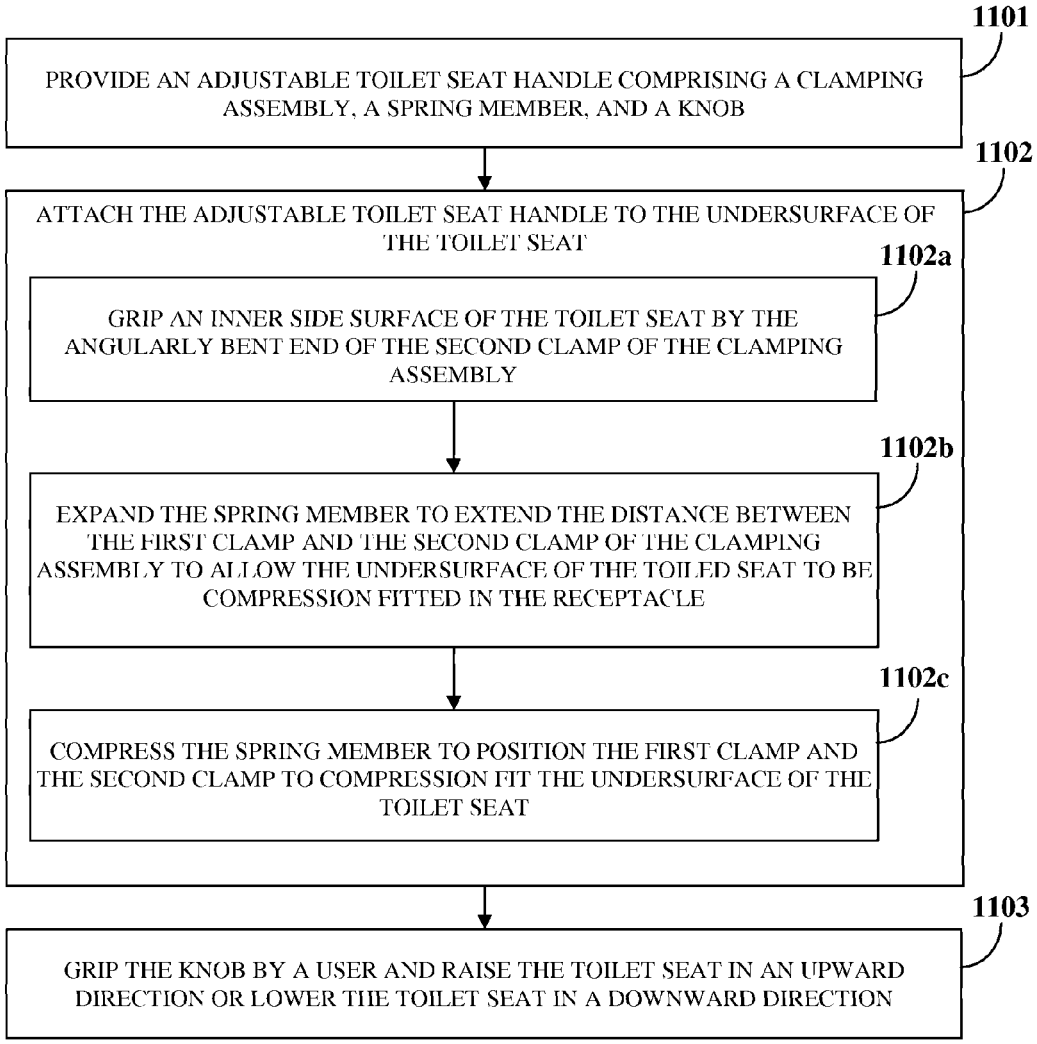
FIG. 11 illustrates a method for raising or lowering a toilet seat without direct contact with the toilet seat.

FIG. 11 illustrates a method for raising or lowering a toilet seat 801 without direct contact with the toilet seat 801 as exemplarily illustrated in FIGS. 8-9. An adjustable toilet seat handle 100 comprising a clamping assembly 101, a spring member 105, and a knob 106 as disclosed in the detailed description of FIGS. 1A-7 is provided 1101. The clamping assembly 101 comprises a first clamp 102 and a second clamp 103 having an angularly bent end 103*b*. The adjustable toilet seat handle 100 is attached 1102 to the undersurface 801*b* of the toilet seat 801 as follows: The inner side surface 801*a* of the toilet seat 801 is gripped 1102*a* by the angularly bent end 103*b* of the second clamp 103 of the clamping assembly 101. The spring member 105 is expanded 1102*b* to extend the distance 109 between the first clamp 102 and the second clamp 103 of the clamping assembly 101 to allow the undersurface 801*b* of the toilet seat 801 to be compression fitted in the receptacle 104. The spring member 105 is compressed 1102*c* to position the first clamp 102 and the second clamp 103 to compression fit the undersurface 801*b* of the toilet seat 801. The upper surface 101*b* of the clamping assembly 101 grippingly contacts the undersurface 801*b* of the toilet seat 801. A user grips 1103 the knob 106 of the adjustable toilet seat handle 100 and raises the toilet seat 801 in an upward direction or lowers the toilet seat 801 in a downward direction without direct contact with the toilet seat 801.

The foregoing examples have been provided merely for the purpose of explanation and are in no way to be construed as limiting of the present invention disclosed herein. While the invention has been described with reference to various embodiments, it is understood that the words, which have been used herein, are words of description and illustration, rather than words of limitation. Further, although the invention has been described herein with reference to particular means, materials, and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

I claim:

1. An adjustable toilet seat handle, comprising:

a clamping assembly configured to removably connect to an undersurface of a toilet seat, said clamping assembly comprising a first clamp and a second clamp;

a first slot positioned at a predetermined location on said first clamp and a second slot positioned at a predetermined location on said second clamp;

a first hook member extending downwardly from the first slot of the first clamp and a second hook member extending downwardly from the second slot of the second clamp;

said second clamp comprising a lower portion and an upper portion opposite said lower portion, wherein said upper portion comprises an angularly bent end configured for gripping an inner side surface of said toilet seat, and wherein said lower portion tapers in a direction of said upper portion;

a spring member operably connected to said first hook member and said second hook member, wherein said spring member is viewed through said slots from a top of said adjustable toilet seat handle for connecting said spring to each of said first hook and said second hook, wherein said first clamp and said second clamp connected together by said spring member define a receptacle, wherein said spring member is expanded to extend a distance between said first clamp and said second clamp of said clamping assembly to allow said undersurface of said toilet seat to be compression fitted in said receptacle, and wherein an upper surface of said clamping assembly is configured to grippingly contact said undersurface of said toilet seat; and a knob rigidly attached to and extending outwardly from said first clamp of said clamping assembly, said knob configured to be gripped by a user to allow said user to one of raise said toilet seat in an upward direction and lower said toilet seat in a downward direction without direct contact with said toilet seat.

2. The adjustable toilet seat handle of claim 1, wherein said first clamp is an L-shaped clamp.

3. The adjustable toilet seat handle of claim 1, wherein said spring member is a tension spring made of stainless steel.

4. The adjustable toilet seat handle of claim 1, wherein a shape of said knob is one of a spherical shape, a cylindrical shape, a cubical shape, a square shape, and a rectangular shape.

5. A method for assembling an adjustable toilet seat handle, comprising:

providing a clamping assembly, a spring member, and a knob, said clamping assembly comprising a first clamp and a second clamp, wherein said knob is rigidly attached to said first clamp of said clamping assembly;

a first slot positioned at a predetermined location on said first clamp and a second slot positioned at a predetermined location on said second clamp;

a first hook member extending downwardly from the first slot of the first clamp and a second hook member extending downwardly from the second slot of the second clamp;

said second clamp comprising a lower portion and an upper portion opposite said lower portion, wherein said upper portion comprises an angularly bent end configured for gripping an inner side surface of said toilet seat, and wherein said lower portion tapers in a direction of said upper portion;

operably connecting said spring member to said first hook member and said second hook member, comprising:

viewing said spring member through said slots from a top of said adjustable toilet seat handle and connecting said spring member to each of said first hook and said second hook, wherein said connected said first clamp and said second clamp define a receptacle;

compression fitting an undersurface of said toilet seat in said receptacle defined by said extended distance between said first clamp and said second clamp, wherein an upper surface of said clamping assembly is configured to grippingly contact said undersurface of said toilet seat, and wherein said angularly bent end configured for gripping said inner side surface of said toilet seat.

6. The method of claim 5, wherein said first clamp is an L-shaped clamp.

7. The method of claim 5, wherein said spring member is a tension spring made of stainless steel.

8. The method of claim 5, wherein said operable connection of said spring member to said lower surface of said clamping assembly comprises inserting a loop opening at each opposing end of said spring member on a hook member that extends downwardly from a slot positioned at a predetermined location on each of said first clamp and said second clamp of said clamping assembly.

9. A method for one of raising and lowering a toilet seat without direct contact with said toilet seat, comprising:

providing an adjustable toilet seat handle comprising:

a clamping assembly comprising a first clamp and a second clamp, said second clamp having an angularly bent end;

a first slot positioned at a predetermined location on said first clamp and a second slot positioned at a predetermined location on said second clamp;

a first hook member extending downwardly from the first slot of the first clamp and a second hook member extending downwardly from the second slot of the second clamp;

said second clamp comprising a lower portion and an upper portion opposite said lower portion, wherein said angularly bent end is located in said upper portion and is configured for gripping an inner side surface of said toilet seat, and wherein said lower portion tapers in a direction of said upper portion;

a spring member operably connected to said first hook member and said second hook member, wherein said spring member is viewed through said slots from a top of said adjustable toilet seat handle for connecting said spring to each of said first hook and said second hook, wherein said first clamp and said second clamp connected by said spring member define a receptacle; and a knob rigidly attached to and extending outwardly from said first clamp of said clamping assembly;

attaching said adjustable toilet seat handle to said undersurface of said toilet seat, said attaching comprising:

gripping an inner side surface of said toilet seat by said angularly bent end of said second clamp of said clamping assembly of said adjustable toilet seat handle;

expanding said spring member said adjustable toilet seat handle to extend a distance between said first clamp and said second clamp of said clamping assembly to allow said undersurface of said toilet seat to be compression fitted in said receptacle; and positioning said first clamp and said second clamp of said clamping assembly to compression fit said undersurface of said toilet seat on releasing said expanded spring member, wherein an upper surface of said clamping assembly grippingly contacts said undersurface of said toilet seat; and gripping said knob of said adjustable toilet seat handle by a user for said one of said raising said toilet seat in an upward direction and lowering said toilet seat in a downward direction without said direct contact with said toilet seat.

10. The method of claim 9, wherein said adjustable toilet seat handle further comprises a hook member extending downwardly below said lower surface of said clamping assembly for supporting said spring member.

11. The method of claim 10, wherein said spring member comprises a loop opening at each opposing end of said spring member for connecting said each said opposing end of said spring member to said hook member.

12. The method of claim 9, wherein said spring member is a tension spring made of stainless steel.

* * * * *